United States Patent [19]

Royer

[11] Patent Number: 4,666,401

[45] Date of Patent: May 19, 1987

[54] GAS FLOWRATE ADJUSTMENT DEVICE FOR A LIQUEFIED-GAS LIGHTER

[75] Inventor: Michel Royer, La Balme De Sillingy, France

[73] Assignee: S.T.Dupont, Paris, France

[21] Appl. No.: 826,707

[22] Filed: Feb. 6, 1986

Related U.S. Application Data

[63] Continuation of Ser. No. 758,906, Jul. 25, 1985, abandoned, which is a continuation of Ser. No. 599,805, Mar. 26, 1984, abandoned.

[30] Foreign Application Priority Data

Jul. 29, 1982 [FR] France ..... 82 13265

[51] Int. Cl.[4] ..... F23Q 2/16

[52] U.S. Cl. ..... 431/344; 251/121; 222/3

[58] Field of Search ..... 431/130, 131, 142, 143, 431/150, 254, 344; 251/120, 121; 222/3

[56] References Cited

U.S. PATENT DOCUMENTS

| | | | |
|---|---|---|---|
| 3,963,413 | 6/1976 | Lockwood et al. | 431/276 |
| 4,080,156 | 3/1978 | Moriya | 341/344 |
| 4,235,589 | 11/1980 | Vallera | 431/344 |

FOREIGN PATENT DOCUMENTS

| | | | |
|---|---|---|---|
| 877427 | 8/1971 | Canada | 431/344 |
| 1457554 | 10/1969 | Fed. Rep. of Germany . | |
| 1632608 | 1/1972 | Fed. Rep. of Germany . | |
| 2247678 | 10/1973 | France . | |
| 2277305 | 1/1976 | France . | |
| 7735860 | 11/1977 | France . | |
| 2389834 | 1/1979 | France | 431/344 |
| 0015774 | 2/1977 | Japan | 431/344 |

*Primary Examiner*—Margaret A. Focarino
*Attorney, Agent, or Firm*—John P. Morley

[57] ABSTRACT

The invention relates to a gas flowrate adjustment and limitation device for a liquefied-gas lighter of the type having at least one compressible element traversed by the gas, and means of compressing this element to a greater or lesser degree depending on the desired flowrate. This device is characterized by having a permeable disk 12, the periphery of which is in contact with a coaxial permeable crown 7, by the gas passage in disk 12 and crown 7 being substantially radial, and by essentially the total surface area of each of the outer surfaces of said disk 12 and said crown 7 being in contact with some element of the device or lighter.

4 Claims, 4 Drawing Figures

GAS FLOWRATE ADJUSTMENT DEVICE FOR A LIQUEFIED-GAS LIGHTER

This application is a continuation of application Ser. No. 758,906, filed July 25, 1985, now abandoned, which in turn is a continuation of application Ser. No. 599,805 filed Mar. 26, 1984, now abandoned.

The present invention relates to a gas flowrate adjustment device for a liquefied-gas lighter, and, in particular, a device enabling the maximum flame height delivered by the lighter to be adjusted to a given value.

Gas flowrate adjustment devices are known which use an elastic, impermeable element, such as rubber, for example, which is compressed against a gas-conveying groove, such as to reduce the desired flowrate to a greater or lesser degree. As is known, this type of device has the disadvantage of delivering a flame which is unstable as a function of time.

In fact, it is known that any material subjected to permanent stress undergoes a creep phenomenon as time passes, which creep essentially increases with the elasticity of the material and with the stress to which it is subjected. As a result, when, as in the present case, the compressed material is rubber, namely an elastic substance, creep phenomena are relatively substantial. They result in deformation of the permeable body which increases as time passes, causing the gas-conveying groove to be blocked to a greater degree, decreasing the flame produced by the lighter.

The use of permeable elastic disks, supplied peripherally with gas and traversed radially thereby, has also been proposed. When such disks are disposed in the lighter body, when the lighter is not in use, creep phenomena in said disks are decreased since, under the effect of compression, the disk cannot move. It will be noted, however, that in this case, substantial compression is likely to create a substantially compressed zone, causing a large flow loss, which can greatly decrease the gas flowrate or even interrupt it. What is more, since the gas usually exits through a passage located in the center of the compressed pellet, and perpendicularly thereto, a creep phenomenon occurs when, due to compression, the material deforms at right angles to the passage, and penetrates same, thus creating an under-compressed zone, which results in a greater flame height.

Finally, there are also lighters in which the flame delivered is limited to a certain value by means causing an additional flow loss, these means being disposed in series with the normal flow adjustment device. Such devices, since they utilize a compressible pellet, also of course have the same creep defects as classical expansion devices.

The goal of the present invention is a gas flowrate adjustment device of the aforementioned type which enables the flame delivered to be adjusted up to a certain value and which, in addition, minimizes the creep phenomenon and its effects on flame stability.

For this purpose, its object is a gas flowrate adjustment and limitation device for a liquefied-gas lighter of the type having at least one compressible element traversed by the gas, and means of compressing this element to a greater or lesser degree depending on the desired flowrate, this device being characterized by having a permeable disk whose periphery contacts a permeable coaxial crown, by the gas path in the disk and the crown being substantially radial, and by each of the outer surfaces of said disk and said crown being in contact over essentially their whole surface areas with some element of the device or lighter.

In general, the permeable disk is made of a compressible material whose compression is adjusted to set the flame to the desired given height. The permeable crown may be made of a sintered material whose porosity, determined when manufactured, enables the maximum flame delivered by the lighter, to be defined. In addition, it ensures retention of the permeable disk and hence prevents it from creeping at its periphery. In addition, in cases when the gas is fed through the periphery, the permeable crown ensures homogeneous feed of the central disk since it is effected over its entire outer surface.

Of course, the reverse arrangement can also be implemented and said disk can be made of a rigid material, for example a sintered material, and the crown can be made of a compressible material. Likewise, the feed can be from the center of the disk and the exit at the peripheral surface of the crown.

According to the invention, in order to prevent creep in the central passage (gas inlet or outlet), essentially the entire outer surface of the permeable disk is in contact with some element of the device. Thus, the central passage can contain a nipple traversing the compressible disk, or a cylinder made of a permeable material such as, for example, a sintered material, the space provided between this nipple and the passage as well as the pore sizes of the sintered material being both sufficiently large not to cause any noteworthy flow loss and sufficiently small for the compressible material not to creep.

In one embodiment of the invention, the disk and crown are both made of a compressible permeable material such as to permit not only preadjustment of the maximum flame but also adjustment of the functional flame.

It will be noted that, in this case, any deformation or residual creep of the disk on the crown (or vice versa) which would decrease its flow loss would in this way be offset by increased compression of the crown (or disk) to produce an increased flow loss therein. The disk-crown combination is thus an automatic creep-offsetting pair.

It will also be noted that, once an additional flow loss is created in the gas circuit by means of the permeable crown, it becomes possible, for a given final flowrate, to compress the disk less and hence decrease creep in the gas inlet or outlet passage.

In a particularly attractive embodiment of the invention, the disk and the crown associated therewith are composed of one and the same part compressed in two different zones. First, a central circular zone and second, an annular zone surrounding the latter. This arrangement, which is simpler and easier to implement, has the same advantages as the preceding embodiment.

Several embodiments of the invention are described hereinbelow with reference to the attached drawings, wherein.

Figure 1:
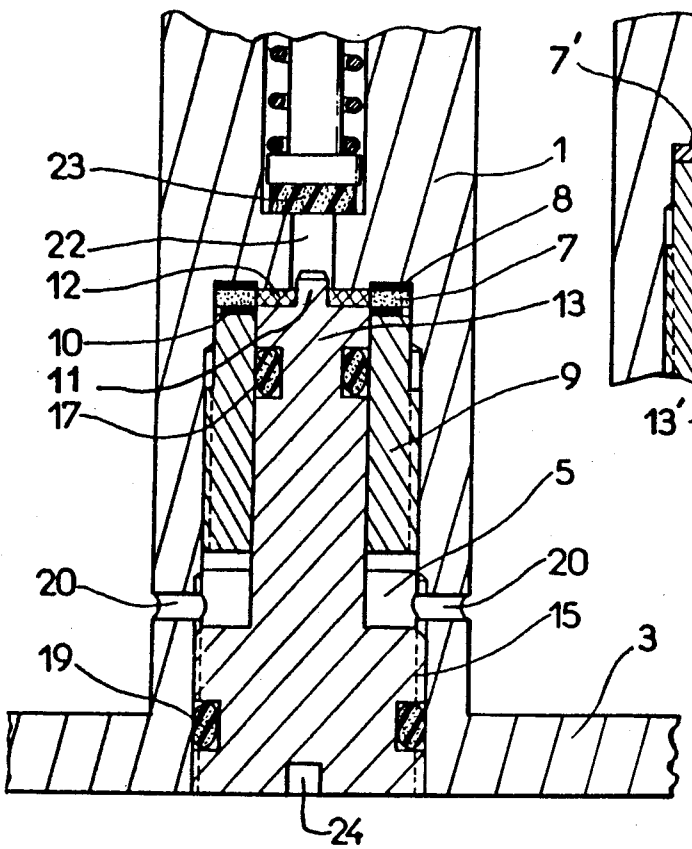
FIG. 1 is a partial lengthwise section through a first embodiment of a flame-height adjustment device according to the invention.

In FIG. 1, the flame-height adjustment device according to the invention is disposed inside a cavity 5 with internal threads, provided in a tube 1 integral with the bottom 3 of the lighter body.

A permeable elastic disk is disposed on the bottom of cavity 5. A permeable between crown 7 made of sintered metal is disposed at the periphery of this disk and in contact therewith. A washer 8 provides gas tightness between crown 7 and tube 1. Crown 7 is held by a screw 9 screwed into cavity 5, with interposition of a washer 10 between screw 9 and crown 7. Disk 12 is compressed in its central part by a compression element 13 screwed by a thread 15 into tube 1. Two O-rings 17 and 19 respectively provide tightness between compression element 13 and screw 9 on the one hand and between body 3 and compression element 13 on the other hand. Tube 1 has orifices 20 and 22 providing communication between the inside of cavity 5 and the gas reservoir of the lighter, and with the burner, respectively.

Compression element 13 is provided with a nipple 11 passing through disk 12. The space between this nipple and passage 22 is sufficiently large for no significant flow loss to be caused and sufficiently small for disk 12 to be unable to creep.

This being the case, the device operates as follows:

The gas arriving through orifices 20 from the reservoir passes through the capillary passage defined by the threads of screw 9 and of cavity 5 to arrive at the periphery of disk 7. As it traverses this disk, it undergoes a first flow loss depending on the porosity of the sintered crown, determined by manufacture. It then passes radially through disk 12, undergoing a second flow loss depending on the compression of this disk. When flap valve 23 is open, the gas finally passes into passage 22 of the burner, not shown in the drawing. It will be noted that disk 12 is held at all its surfaces by the various elements of the device and hence is unable to undergo substantial creep phenomena as a function of time.

Figure 2:
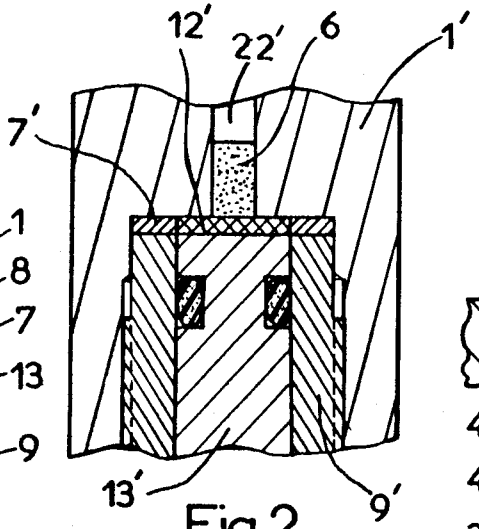
FIG. 2 illustrates an alternative embodiment of the device in FIG. 1.

FIG. 2 is a partial view of an alternative embodiment of the device in FIG. 1. The elements already described in relation to FIG. 1 or having equivalent functions, are designated by the same reference numbers plus a prime (').

In this alternative, crown 12 is replaced by a disk 12'. Crown 7' and disk 12' are made of two permeable compressible materials and are compressed by screws 9' and 13' respectively, which enable the maximum flame height and the functional flame height delivered by the lighter, respectively, to be adjusted. A porous cylinder 6, made of a sintered material, is mounted in the gas exit passage in contact with disk 14. It is sufficiently porous to create no noteworthy flow loss as the gas passes. During compression, disk 12' rests on said cylinder 6 and hence cannot creep in gas outlet passage 22'.

The operation of this alternative is similar in every respect to that of the device in FIG. 1.

Figure 3:
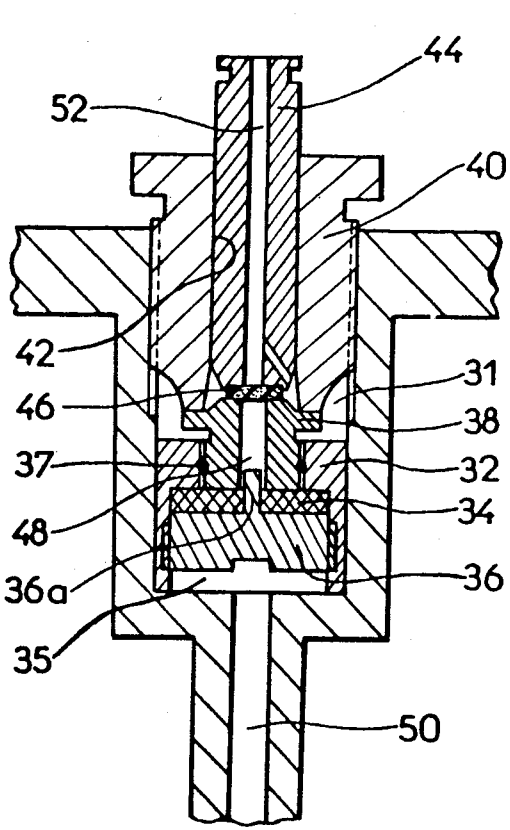
FIG. 3 is a partial lengthwise section through a second embodiment of a flame-height adjustment device according to the invention.

In the embodiment in FIG. 3, the central disk and its crown are composed of one and the same part, a disk 34, and the flame height is adjusted from the upper part of the lighter. The latter is provided with a cavity 31 which houses a subassembly composed of a support 32, in which an internal recess 35 contains permeable elastic disk 34. The latter is compressed axially by a screw 36 screwed into an inside thread of recess 35. A centering nipple 36*a* on screw 35 is engaged in an axial orifice of disk 34.

The upper part of support 32 is provided with an orifice 39 which contains a compression element 38. The latter is applied against the center part of disk 34 by a screw 40 which is screwed into cavity 31 of the lighter body and which can be actuated from the outside. This screw 40 has a central passage 42 receiving a burner 44, one end of which is provided with a flap valve 46. The latter rests on the upper surface of compression element 38 and blocks a passage 48, causing disk 34 to communicate with the burner.

The device operates as follows: the gas leaves the reservoir via a passage 50 which opens into the base of cavity 31, passes through the capillary part between the threads of screw 36 and support element 32, and thus arrives at the periphery of disk 34. It then passes through the latter radially, reaching passage 48 of the compression element. When flap valve 46 is opened, the gas then reaches passage 52 of the lighter burner. By compressing disk 34 in its annular part with the aid of screw 36 to a greater or lesser degree, it is thus possible to establish the maximum flame height the lighter can produce, then, by compressing the same disk 34 in its central part with the aid of screw 40 to a greater or lesser degree, the user can adjust the flame height produced by the lighter to any value up to that of the maximum flame height previously set.

Figure 4:
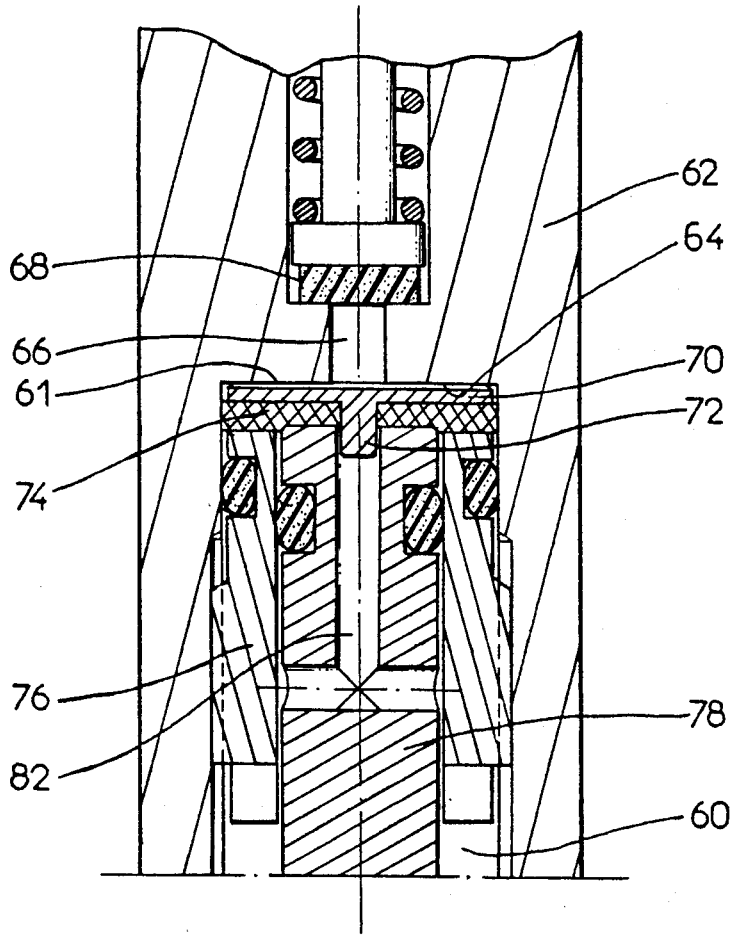
FIG. 4 represents another embodiment of the device according to the invention.

In the embodiment of FIG. 4, the gas flowrate adjustment device according to the invention is accommodated in a cavity 60 of a tube 62. The bottom of this cavity communicates with a burner, not shown in the drawing, via a passage 66 which can be blocked by a flap valve 68.

A metal disk 70 provided in its upper part with fine radial grooves 61 and having a central nipple 72 oriented toward the inside of cavity 60 is disposed on bottom 64 of said cavity.

In this embodiment as well, the permeable disk and crown are combined into a single disk 74, the annular part of which is compressed by screw 76 screwed into tube 62, and the central part of which is compressed by a piston 78 passing through a bore 80 of screw 76.

Piston 78 is provided with a gas inlet passage 82 and a nipple 72 of metal disk 70 passes through disk 74 to penetrate passage 82, thus minimizing the creep of the central passage.

The device operates as follows: The gas from the lighter reservoir (not shown in the drawing) is admitted by the capillary passage composed of the space between bore 80 and piston 78 and reaches the center of permeable disk 74 via passage 82. It then passes through the two compression zones of disk 74 where it undergoes a flow loss, depending on the position of piston 78 and screw 76, then reaches passage 66 via grooves 64.

Hence, the invention offers a simple, reliable device for adjusting the gas flowrate of a liquefied-gas lighter, which not only overcomes the creep problems occurring in devices of the prior art, but also enables the maximum flame height and functional flame height of the lighter to be adjusted to a given value.

I claim:

1. A device for adjusting and limiting the gas flowrate of a liquified-gas lighter of the type having a compressible element traversed by the gas and means for compressing this element to a greater or lesser degree depending on the desired flowrate, said device being characterized by having a permeable disk element (12, 12') the periphery of which is in contact with a permeable coaxial crown element (7, 7') by the gas passage in the disk and crown elements being substantially radial, by one of the elements being made of a compressible material and the other being made of a non-compressible porous material, by essentially the total area of each of the outer surfaces of the disk and crown elements being in contact with some element of the device or lighter and by independent compression means arranged in operational communication with the element made of the compressible material so that compression of the element communicating with the compression means adjusts the gas flowrate in that element independently of any adjustment of the gas flowrate in the other element.

2. A device of claim 1 where the non-compressible porous material is a sintered material.

3. A device of claim 1 where the permeable crown element (7, 7') is made of a sintered material.

4. A device of claim 1 where the permeable disk element (12, 12') is made of a sintered material.

* * * * *